US005242233A

United States Patent [19]

Sirota

[11] Patent Number: 5,242,233

[45] Date of Patent: Sep. 7, 1993

[54] TOOTHBRUSH WITH SPIRAL CONVEYOR

[76] Inventor: Yossef Sirota, 1235 Beedie Drive, Coquitlam, British Columbia, Canada, V3R 1C3

[21] Appl. No.: 658,963

[22] Filed: Feb. 22, 1991

Related U.S. Application Data

[63] Continuation-in-part of Ser. No. 442,276, Nov. 28, 1989, abandoned.

[51] Int. Cl.[5] ..... A46B 11/00; A46B 11/02

[52] U.S. Cl. ..... 401/146; 222/413; 401/149; 401/172; 401/175; 401/268

[58] Field of Search ..... 401/268, 172, 175, 149, 401/146; 222/413; 198/661

[56] References Cited

U.S. PATENT DOCUMENTS

| | | | |
|---|---|---|---|
| 870,257 | 11/1907 | Stevens . | |
| 1,053,645 | 2/1913 | Reimer | 401/149 X |
| 1,711,183 | 3/1929 | Smith . | |
| 1,880,840 | 10/1932 | Currier | 222/413 X |
| 2,294,285 | 9/1939 | Chu . | |
| 2,409,847 | 10/1946 | Gregg . | |
| 2,507,250 | 2/1945 | Eastin . | |
| 3,008,172 | 12/1958 | Thompson . | |
| 3,411,213 | 11/1968 | Spinello | 222/413 X |
| 4,149,552 | 4/1979 | Stewmon . | |
| 4,167,238 | 9/1979 | Koski | 222/413 |
| 4,530,369 | 7/1985 | Adams . | |
| 4,767,025 | 8/1988 | Gebauer . | |
| 4,906,120 | 3/1990 | Sekiguchi et al. | 401/175 X |

FOREIGN PATENT DOCUMENTS

| | | | |
|---|---|---|---|
| 2607166 | 8/1972 | Fed. Rep. of Germany | 401/175 |
| 674267 | 1/1930 | France | 401/172 |
| 757154 | 10/1933 | France | 401/175 |

*Primary Examiner*—Steven A. Bratlie

[57] ABSTRACT

A dispenser having a hollow body to receive a flowable material. The body is generally conical and has a wider end and a narrower end. There is an outlet at the narrower end. A spiral conveyor within the hollow body is able to rotate relative to the body. Rotation of the spiral conveys material received in the body through the outlet. The spiral conveyor is generally conical and extends into a point adjacent the passageway. At least that part of the conveyor within the extension is a flexible resilient coil in contact with, or close to, the interior of the body adjacent the bristles. In the preferred embodiment, the dispenser is a toothbrush with bristles formed on the narrower end of the body and the outlet communicating with the bristles. There are various ways in which one handed operation of the dispenser can be achieved.

1 Claim, 10 Drawing Sheets

TOOTHBRUSH WITH SPIRAL CONVEYOR

This is a continuation-in-part of Ser. No. 442276 filed Nov. 28, 1989 now abandoned.

This invention relates to a dispenser for dispensing a viscous liquid from a supply of the liquid and finds application in a toothbrush, glue applicator, fountain pens and mascara brushes. The invention has particular application in fountain toothbrushes, a term that is intended to mean a toothbrush carrying its own supply of toothpaste.

The majority of toothbrushes sold comprise the familiar brush to which toothpaste is applied from a separate tube. There have, however, been suggestions to carry the toothpaste in a compartment in the brush. At what might be considered the simplest level the compartment receives a small tube of toothpaste which maybe removed and squeezed to expel the toothpaste.

There have been attempts to produce fountain toothbrushes in which the toothpaste is stored within the hollow body of the brush and can be conveyed along the body directly to the bristles, typically through a passageway extending from the interior of the fountain toothbrush to the bristles. Examples of this prior art include U.S. Pat. Nos. 2,294,285 to Chu, 4,530,396 to Adams, 2,507,250 to Easton, 1,711,183 to Smith and 4,149,552 to Stuman.

In general, these patens show fairly complicated structures of some mechanical sophistication useful in a commercial dispenser in frequent use. Such sophistication is undesirable in a simple domestic article, such as a toothbrush, which is used only intermittently. In all, attention was given as to how to promote the flow of paste within the wider part of the container and no attention was given as to how to promote paste intermittently. through the narrowed, elongated end of the brush to the bristles. A distinction may be drawn between intermittent flow in a device used relatively infrequently, for example by a single individual, and continuous flow, for example a dispenser in a public place. Where there is a restriction, a bottle neck is created. With continuous flow the bottle neck effect is overcome by pressure, but for intermittent use the bottle neck effect cannot be overcome by pressure due to adhesion of the material to the sides of the dispensing vessel.

Other representative art includes U.S. Pat. Nos. 4,767,025 to Gebauer, 3,008,172 to Thompson, 870,257 to Stevens and 2,409,847 to Gregg. In general, this second group of patents teaches the feeding of pastes of one sort or another using a screw conveyor.

The present invention seeks to provide a simple structure that is durable and yet effective the use of valves and the like, as found in prior art such as the above patent to Chu, does not form a part of the present invention. The device can also be used intermittently. Intermittent use of a dispenser is not important in industrial use or commercial use where consistent use is achieved. However, in domestic use the use is intermittent which means that blocking of an elongated nozzle and outlets from the nozzle to the bristles can take place.

Accordingly, the present invention provides a dispenser having a hollow body to receive a flowable material, the body being generally conical;

an outlet at the distal end of the body;

a spiral conveyor within the hollow body able to rotate relative to the body to convey material received in the body through the outlet to the bristles, the spiral conveyor being of generally conical configuration and being in contact with the surface of the dispenser at least in the area adjacent to the bristles, at least that part of the conveyor adjacent the narrower end being a flexible, resilient coil in contact with the interior of the distal end of the body.

In a preferred embodiment the invention provides a toothbrush with bristles mounted on a pad formed on the narrow part of the body and the outlet communicating with the pad and with the bristles.

In a further preferred embodiment the spiral coil conveyor is in contact with the interior of the hollow body throughout the length of the body and also contacts the opening from the body.

The invention is illustrated in the accompanying drawings in which:

FIG. 1 illustrates a spiral coil conveyor useful in a preferred embodiment of the present invention;

FIGS. 2 through 2*d* illustrate a variety of toothbrush bodies useful in the present invention;

FIG. 2*e* shows the component parts together and is partially in section;

FIGS. 3 through 3*d* illustrate conveyors useful in the dispensers of the present invention;

FIGS. 4 through 4*b* illustrate variations in body shapes;

FIG. 5 illustrates a further body shape;

FIGS. 5*a* through 5*c* illustrate conveyors useful in the body shape of FIG. 5;

FIG. 6 illustrates a further variation in body shape;

FIGS. 6*a* through 6*b* illustrate a formation of conveyor useful in the body shape of FIG. 6;

FIG. 7 and 7*a* illustrate a further embodiment of the present invention;

FIGS. 8 to 8*b* illustrate yet a further embodiment to the invention;

FIGS. 9 to 9*c* illustrate alternative outlet points for the invention;

FIG. 10 illustrates a specific aspect of the present invention;

FIG. 10*a* illustrates a further aspect of the present invention;

FIGS. 11 and 11*a* illustrate a further embodiment of the invention;

FIGS. 12 and 12*a* illustrate an embodiment of the invention operable by one hand;

FIGS. 13 through 13*b* illustrate the in situ formation of the coil in an embodiment of the present invention;

FIGS. 14 and 14*a* illustrate embodiments of the invention useful in the application of mascara;

FIGS. 15 and 15*a* illustrate further aspect of the present invention;

Figure 18:
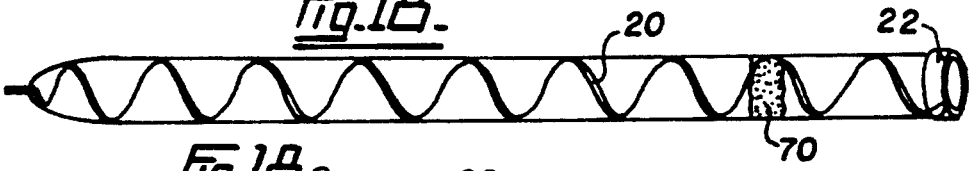
FIG. 18 illustrates in section, a pen according to the present invention.
Figure 18A:
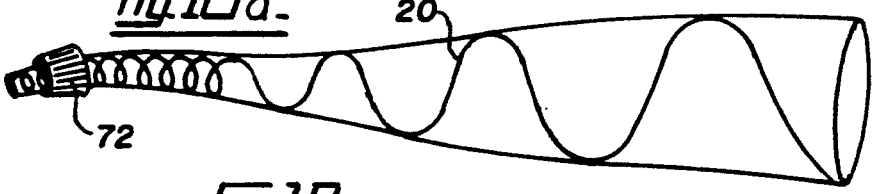
Figure 19:
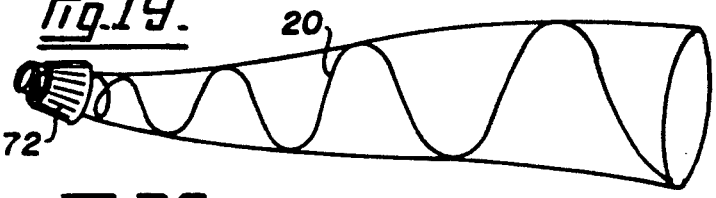
Figure 20:
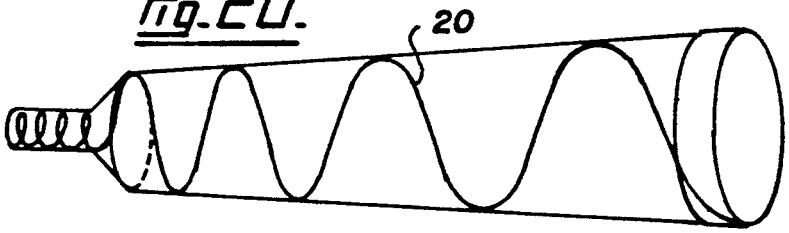
Figure 21:
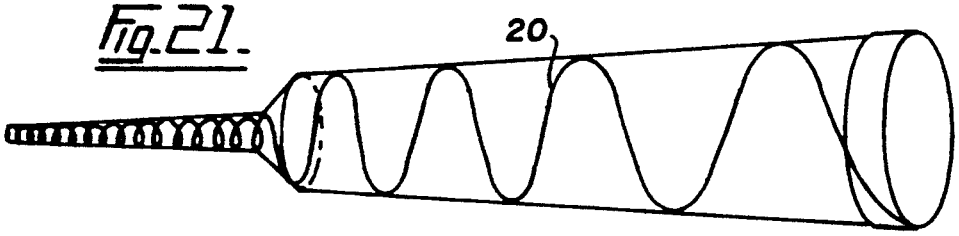
Figure 22:
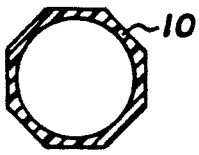
Figure 22A:
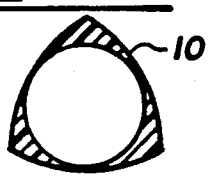
Figure 22B:
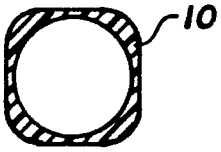
Figure 22C:
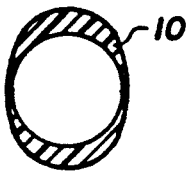
Figure 23:
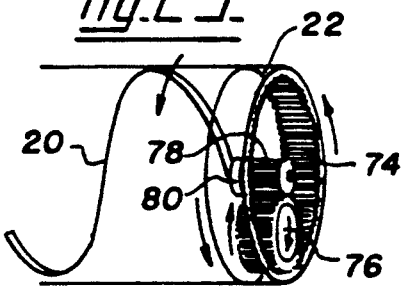
Figure 23A:
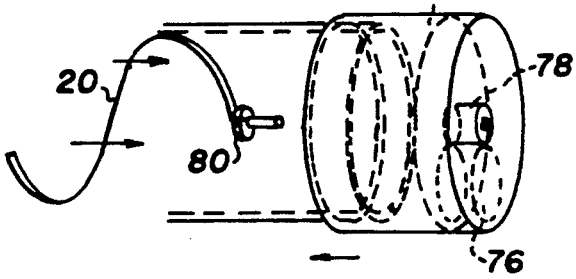
Figure 24:
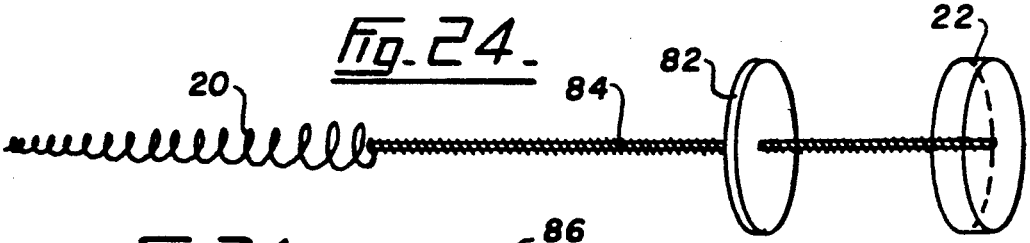
Figure 24A:
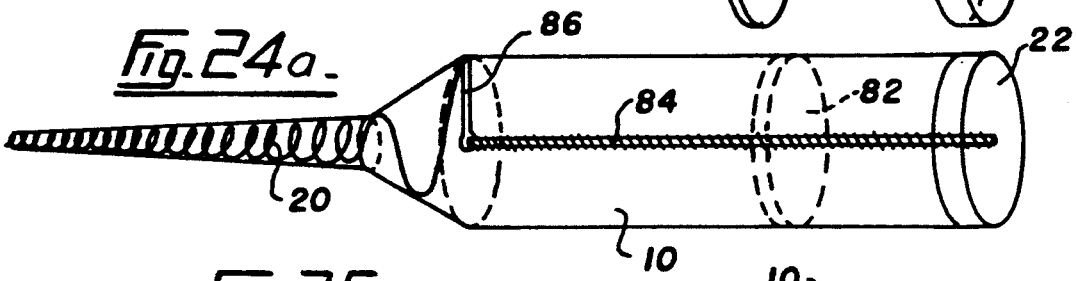
Figure 30:
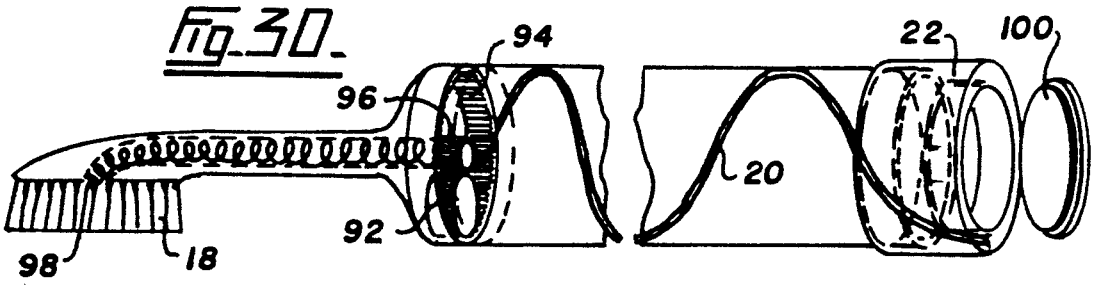
Figure 31:
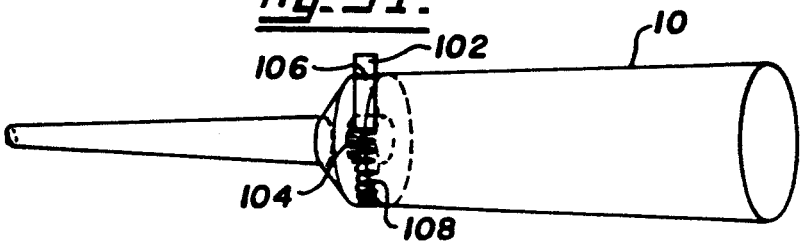
Figure 31A:
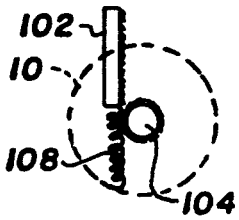
Figure 32:
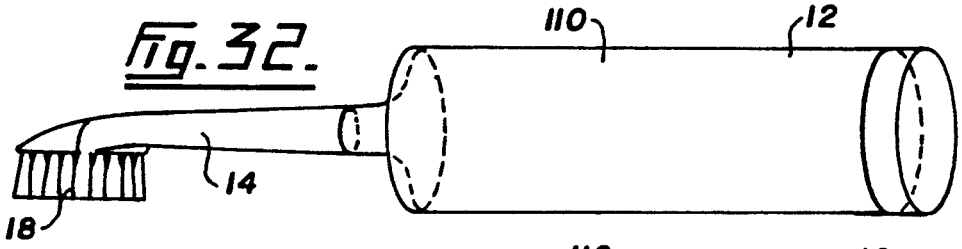
Figure 33:
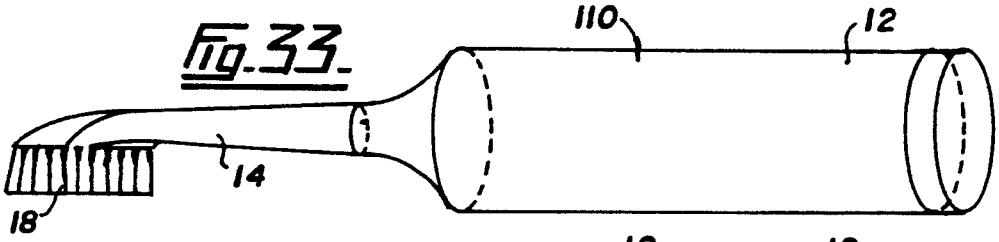
Figure 34:
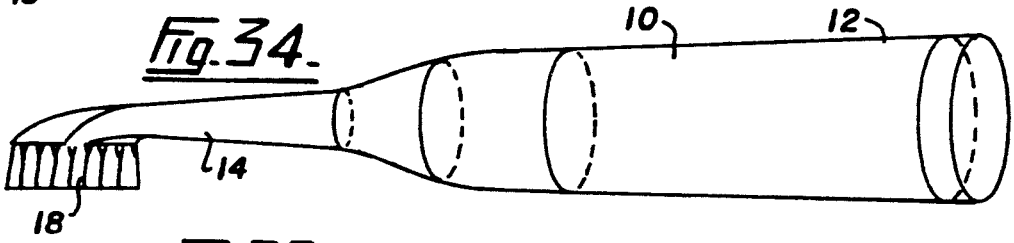
Figure 35:
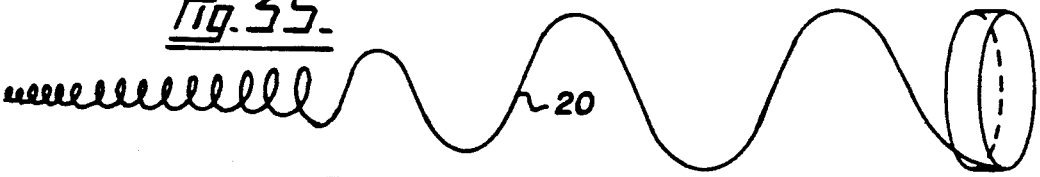

FIG. 18*a* illustrate a further glue dispenser;

FIGS. 19 through 21 illustrates additional dispenser;

FIGS. 22 through 22*c* show variations in body cross-sectional shapes;

FIGS. 23 and 23*a* illustrate a further embodiment of the present invention;

FIGS. 24 and 24*a* illustrate a further embodiment of the invention;

FIGS. 25 through 29 illustrate variation in the shape of the body of the present invention;

FIG. 30 illustrates a further embodiment of a present invention;

FIGS. 31 and 31*a* illustrates a "push bottom" mode of operations;

FIGS. 32 to 34 illustrate a further body shape;

FIGS. 35 illustrates a conveyor useful in the present invention; and

Figure 36:
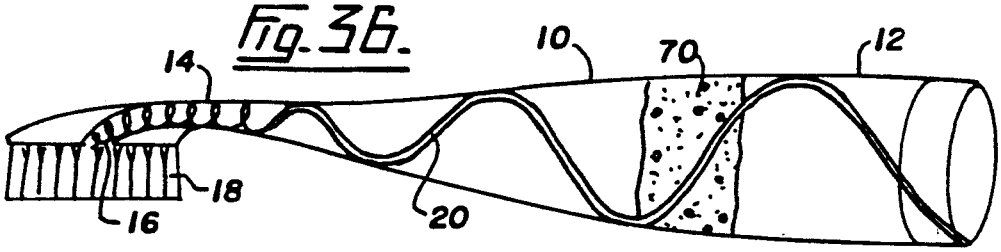

FIG. 36 illustrates yet a further aspect of the invention;

The drawings show a dispenser having a hollow body 10 to receive a flowable substance. The flowable substance may be, as discussed above, ink, toothpaste, glue, grease, cream and the like. It is only necessary that the material be flowable.

Figure 1:
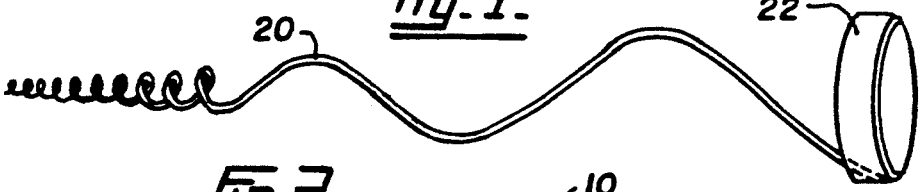
Figure 2:
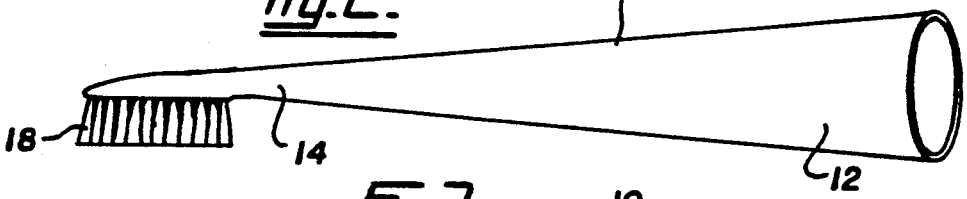
Figure 2A:
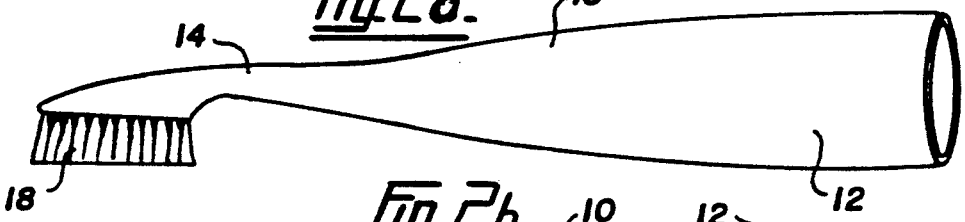
Figure 2B:
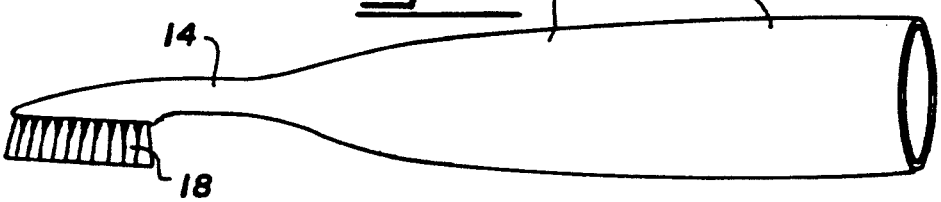
Figure 2C:
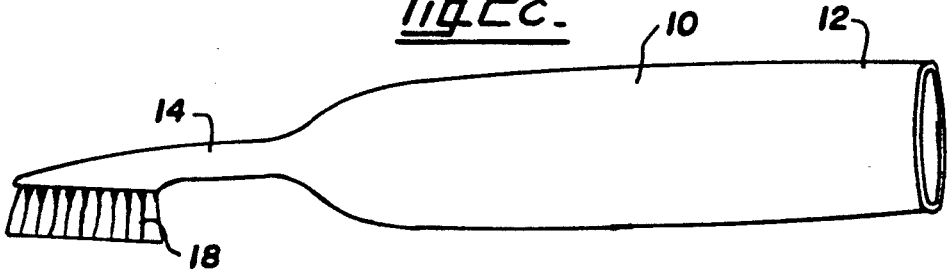
Figure 2D:
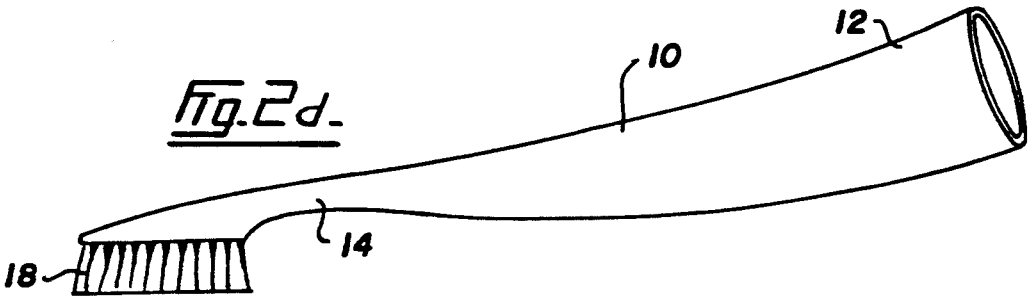

All the bodies show a main body 10 tapering 1 from one end 12 to a narrower end 14 in a generally conical configuration. The tapering may be gradual, for example as shown in FIGS. 2 and 2*a* and 2*d* or fairly abrupt as shown in FIGS. 2*b* and 2*c*. FIGS. 5, 32, 33 and 34 illustrate more abrupt shaping of the body.

There is an outlet or passageway 16 that communicates with bristles 18 formed at the narrower end 14 of the body 10 and through which the flowable material passes from the body 10 to the bristles 18.

Figure 2E:
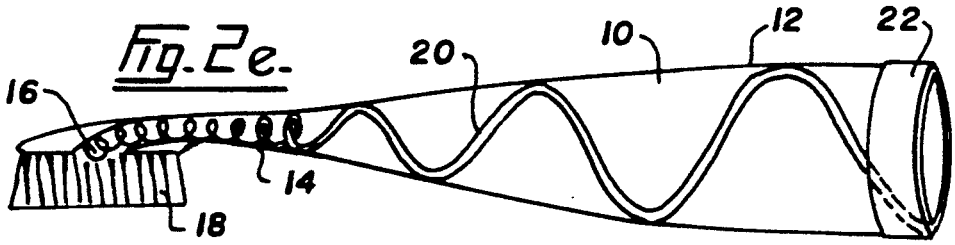

The bodies 10 include a spiral conveyor 20 that extends to the passageway 16 or, at the very least, closely adjacent to that passageway. In a preferred embodiment, for example as shown in FIG. 2*e*, the conveyor 20 extends into the opening 16 thus providing a means of clearing the opening 16, when the toothbrush is used merely intermittently.

All embodiments show the use of a rotatable cap 22 on the end 12 of the body 10, that is remote from the outlet 16. The spiral conveyor 20 is attached to the cap 22 so that the spiral 20 can be rotated by rotation of the cap 22. To fill the dispenser, the cap 22 can simply be removed or an opening in the cap can be provided through which the flowable material can be fed into the body of the dispenser as shown in FIG. 30*a*.

Figure 3:
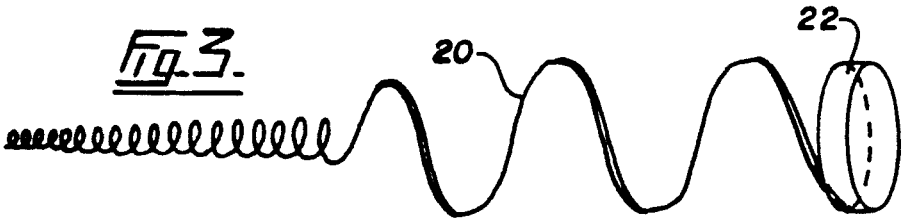
Figure 3A:
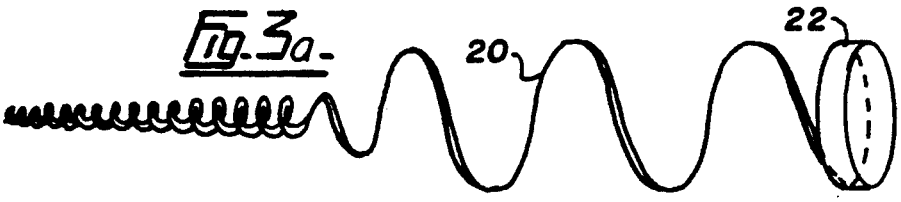
Figure 3B:
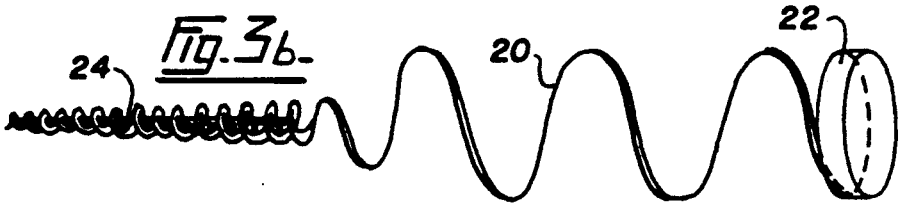
Figure 3C:
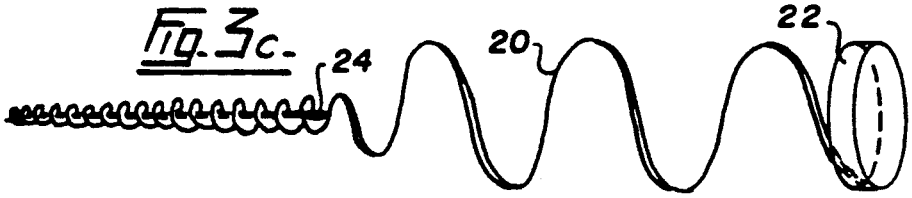
Figure 3D:
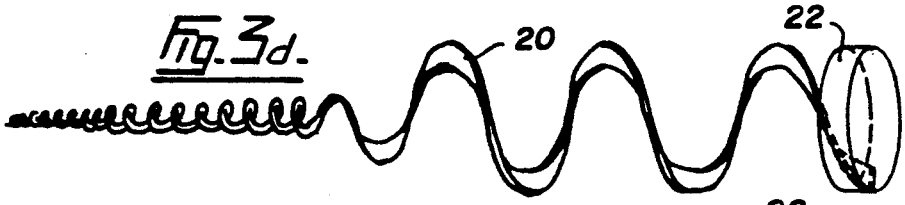

FIGS. 3 through 3*d* show the cap 22 attached to conveyors 20. As indicated particularly in FIGS. 3 the spiral conveyor may be a thin coil throughout its length with, generally, far more coils per unit length in the narrower end of the conveyor 20 than in the wider. This is because the essence of the invention is to ensure the usefulness of the narrower passage of the body 10, and the inventor has found that the important point is to be able to feed flowable substance through the narrower end 14 of the body 10 feeding of flowable substance through the larger section of the body is not a difficult problem.

FIG. 3*a* shows a narrow round cross-section coil with a flat cross-section conveyor in the narrower part of the body. FIG. 3*b* shows the ribbon-like conveyor with a central supporting member 24 and FIG. 3*c* shows a conveyor of relatively wide cross-section in the narrow section of the body.

FIG. 3*d* shows the use of a flat cross-section conveyor throughout the length of the body useful for less adhesive material such as grease.

Figure 4:
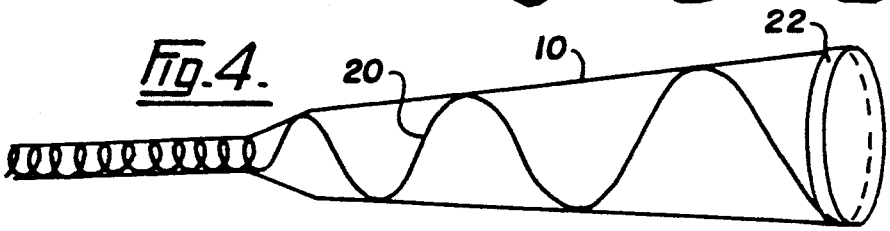
Figure 4A:
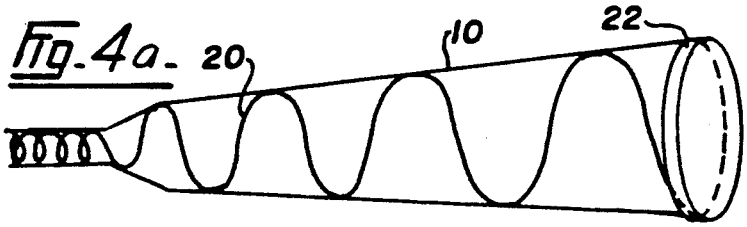
Figure 4B:
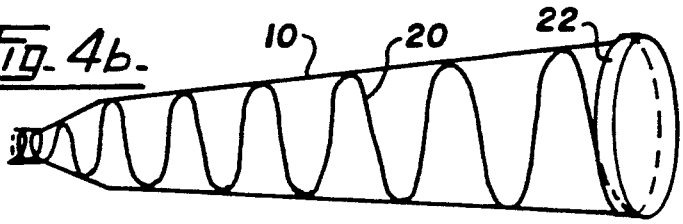

FIGS. 4 to 4*d* show a device useful, for example, as a glue dispenser where a simple cap (not shown) would be placed on the narrower end of the body 10 to keep air from the body when it is not in use. Again the conveyors shown in FIGS. 4*a* to 4*b* are narrow section conveyors having relatively few turns per unit length in the wider section and a large number of turns per unit length in the narrower, more important section of the dispenser. The drawings demonstrate short nozzles and elongated nozzles with a bottle neck effect being most pronounced in the elongated nozzle. This may be overcome by varying the number of turns per unit length of conveyor in the short nozzle—see FIG. 4*b*.

Figure 5:
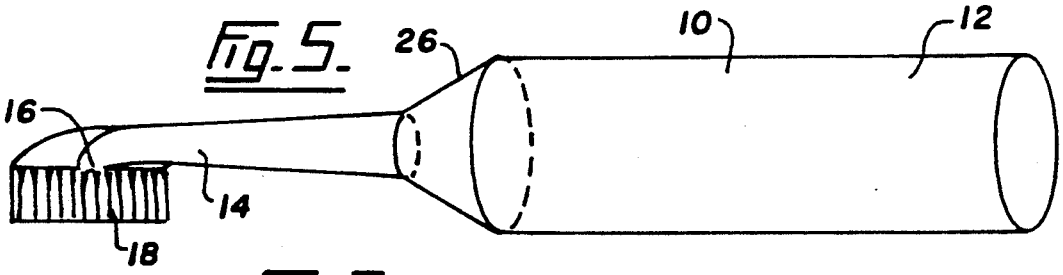
Figure 5A:
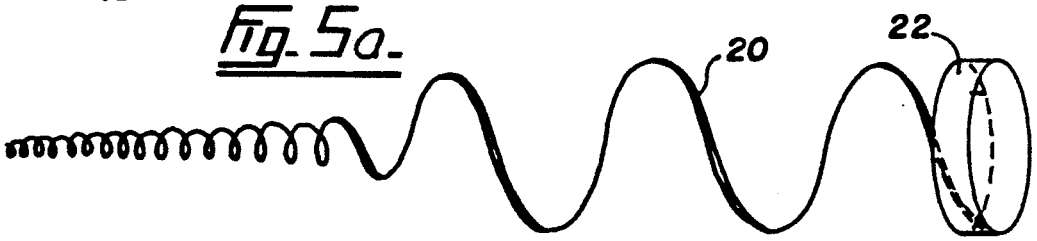
Figure 5B:
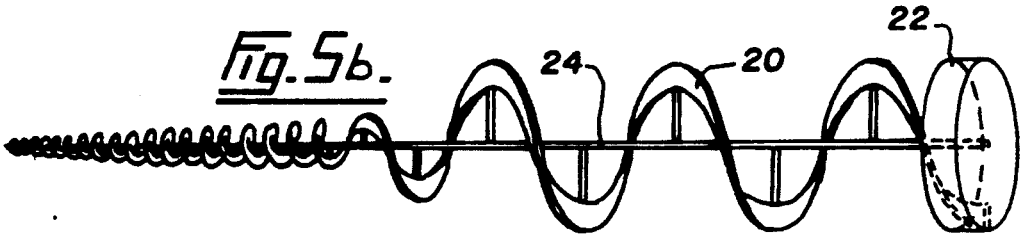
Figure 5C:
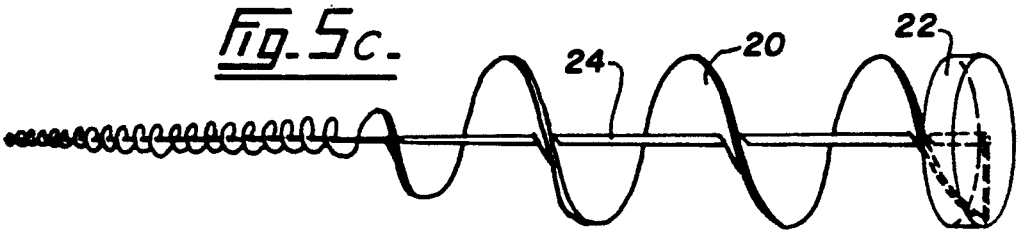
Figure 6:
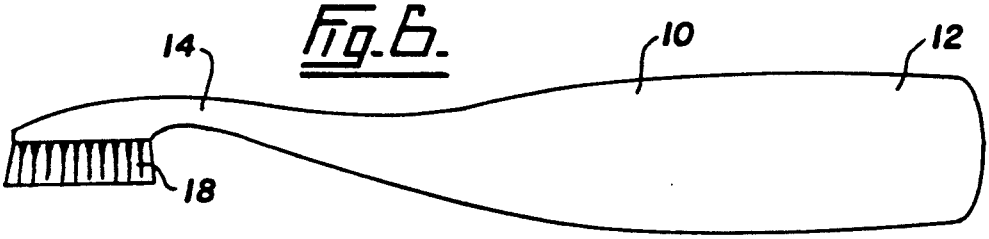
Figure 6A:
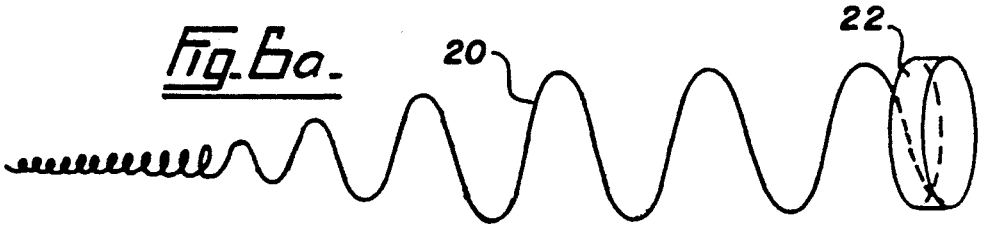
Figure 6B:
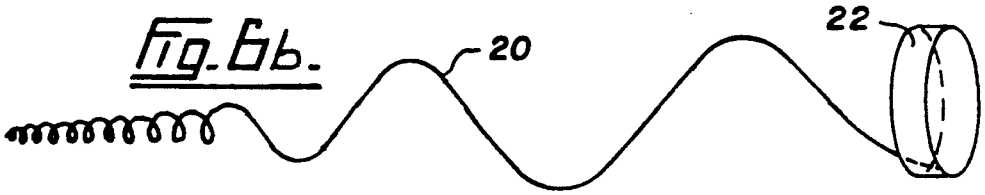

FIG. 5 shows an abrupt change at 26 from a cylindrical wide body to a cylindrical narrower section formed at tapering shoulder 26. FIGS. 5*a* to 5*c* resemble the conveyors of FIGS. 3 to 3*d* and are useful in the body shape of FIG. 5. FIGS. 6 to 6*b* illustrate the use of a flexible coil in FIGS. 6*a* and FIG. 6, illustrates the wide variety of body shapes possible with the use of the flexible coil. FIGS. 5*a* to 5*c* show a stronger conveyor then that shown in FIG. 3 but one that has not better effect to flow than the thin coil within the wide body.

Figure 7:
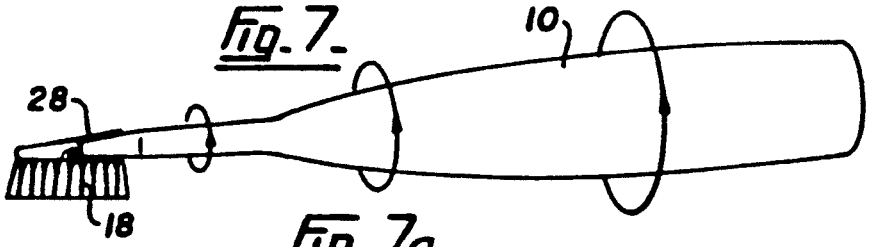
Figure 7A:
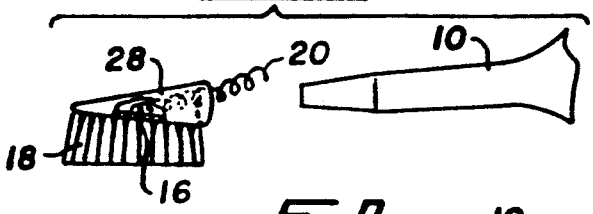

FIG. 7 illustrates the attachment of bristles 18 on an end member 28 in communication with an outlet of the body. The screw conveyor within the body can be anchored to the bristles whereby rotation of the body 10 relative to the conveyor can convey flowable substance from the body 10 to the bristles 18.

Figure 8:
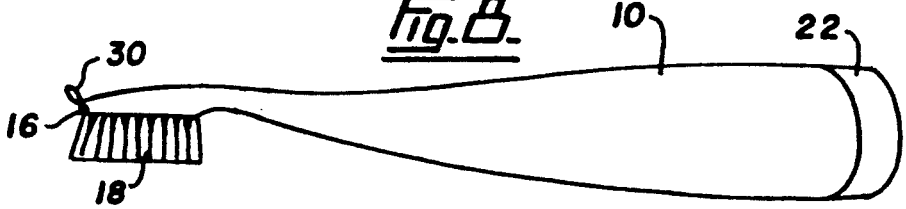
Figure 8A:
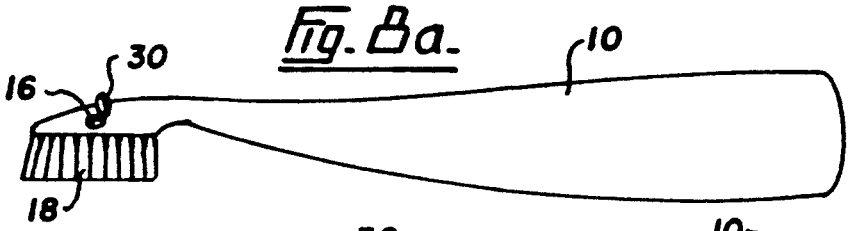
Figure 8B:
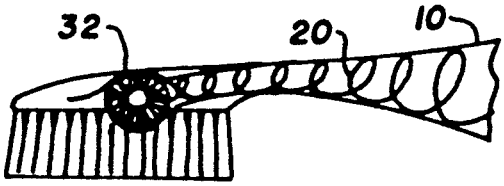

FIGS. 8 and 8*a* show the use of caps 30 on outlets 16. Similarly FIG. 8*b* shows the use of an outlet in one side of the body. Contact of a wheel 32 with the gums can therefore be used to rotate the spiral conveyor 22 within the body 10, thus providing an automatic feed of paste.

Figure 9:
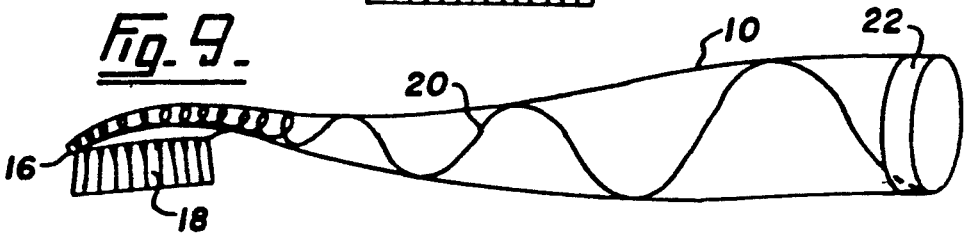
Figures 9A, 9B, 9C:
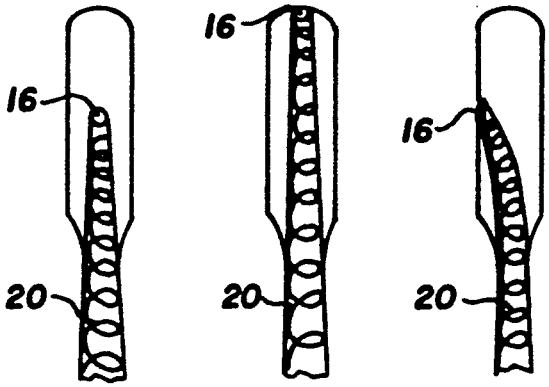

FIG. 9 shows the outlet positioned at the extreme end of the brush. FIG. 9*a* feeds to the center of the bristles, FIG. 9*b* is a plan view of FIG. 9 and FIG. 9*c* shows, as in FIG. 8*b*, an outlet at the side of the bristles.

Figure 10:
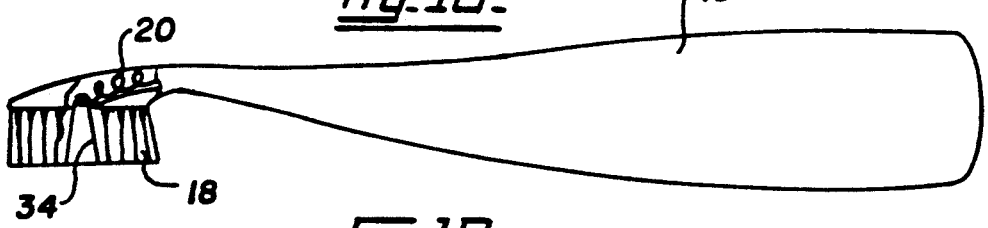
Figure 10A:
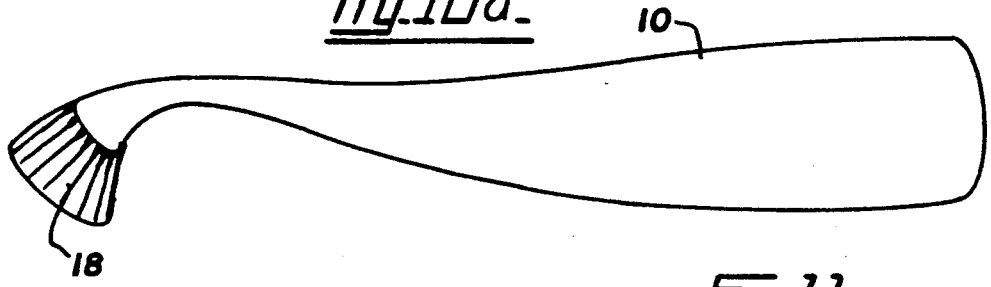

FIG. 10 shows a further drive method whereby a single spike 34 projecting downwardly through the bristles 18 can engage the teeth to rotate the conveyor 20 within the body 10, thus again providing automatic feeding during use. FIG. 10*a* illustrates a different configuration of bristles 18.

Figure 11:
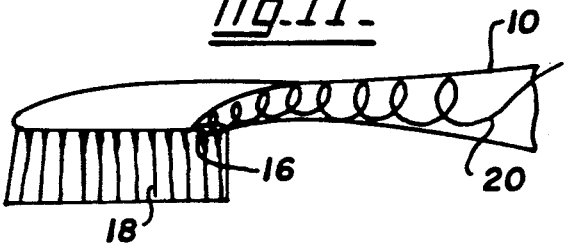
Figure 11A:
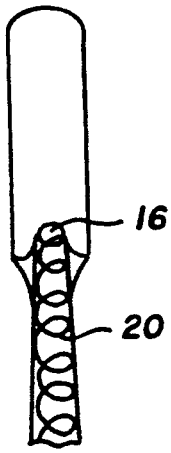

FIG. 11 and FIG. 11*a* show the outlet 16 adjacent to the end of the bristles 18 closer to the wider section 12 of the body 10.

Figure 12:
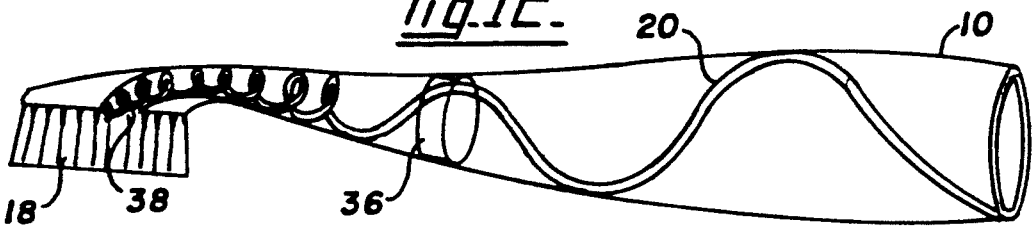
Figure 12A:
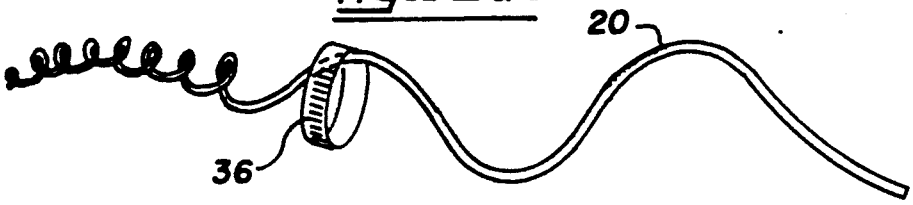

FIGS. 12 and 12*a* show the conveyor 20 having a ring 36 attached to it. The ring 36 projects through an opening 38 in the body shown in FIG. 12 whereby rotation of the ring 36 rotates the conveyor to propel paste to the bristles 18. The cap is omitted in these Figures.

Figure 13:
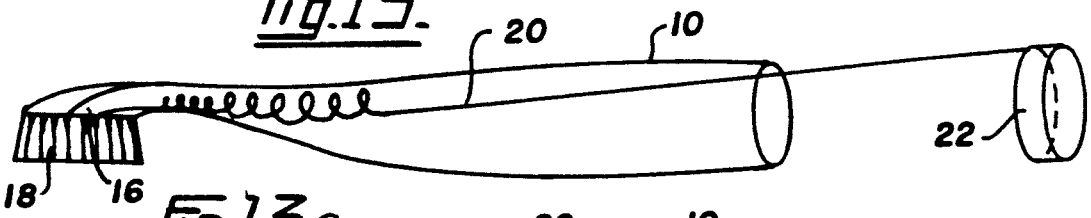
Figure 13A:
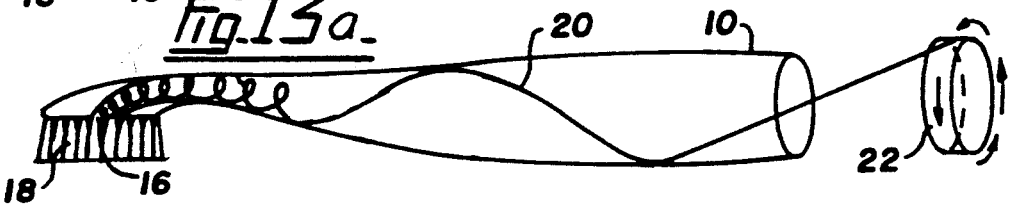
Figure 13B:
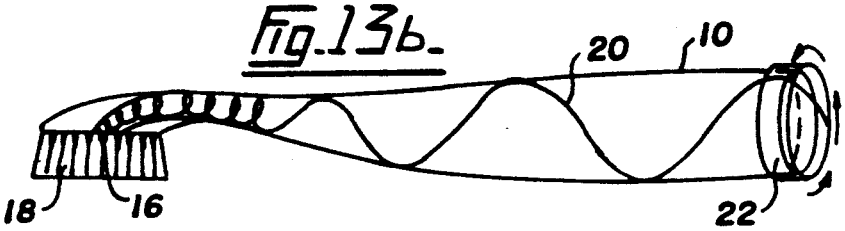

FIGS. 13 to 13*b* illustrate the formation of the coil conveyor 20 in situ. Flexible material can be used and can be coiled into the body 10 as shown in FIG. 13. The coil, with the cap attached, is position as shown in FIG. 13. The cap 22 is rotated to form the coil. Further rotation of the coil when it is in place, as shown in FIG. 13*b*, then acts to feed paste from the body 10. A coil formed in this way prevents opposite rotation.

Figure 14:
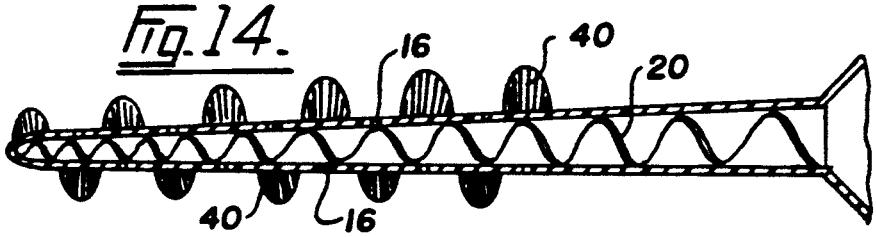
Figure 14A:
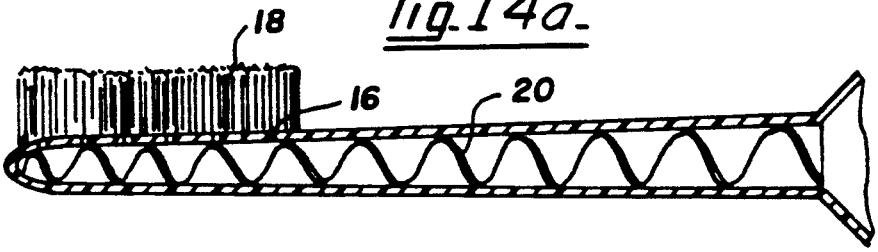
Figure 15:
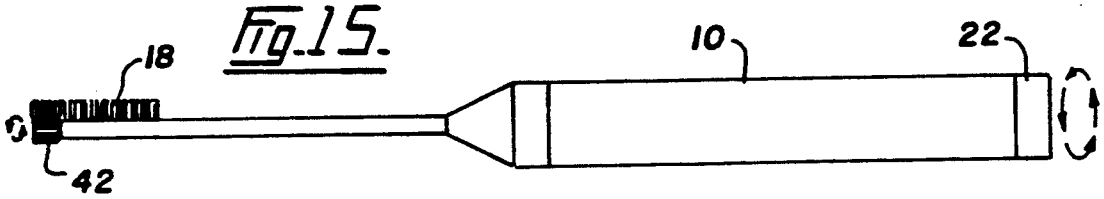
Figure 15A:
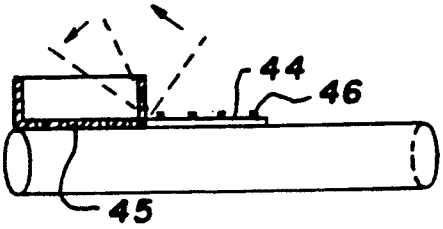

FIGS. 14 to 15*a* show a mascara brush. In FIG. 14 the coil 20 feeds through outlets 16 to bristles 40 arranged in a spiral around the narrower end of the body. In FIG. 14 there is plurality of outlets through which the coil feeds. FIG. 15 shows the user of a member 42 adjacent one end of the body 10. Rotation of that member 42, which is attached to the coil, feeds paste to the bristles. FIG. 15*a* illustrates that the bristles may be formed into two separate parts on each side of a central channel. If necessary, the channel can be closed by a pivotal plate 44 formed with projections 46 that engage the openings 44 to prevent their blocking by setting.

Figure 16:
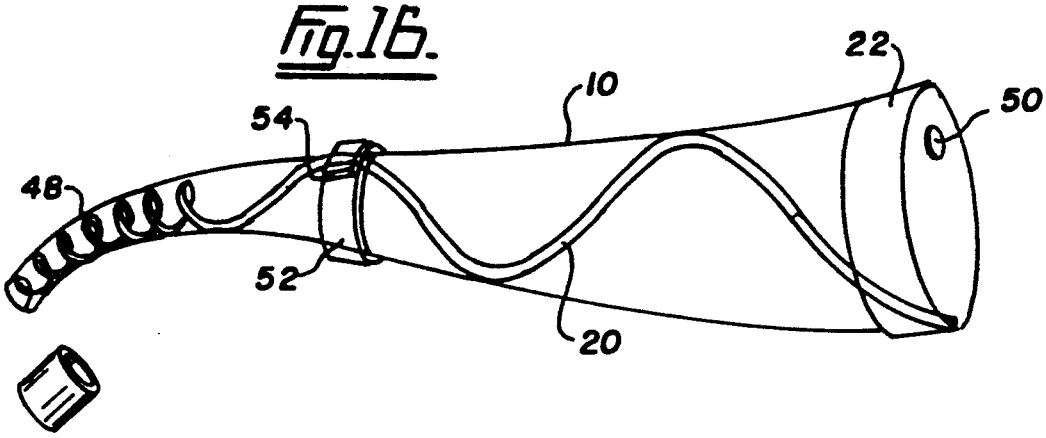
FIG. 16 illustrates a glue dispenser.

FIG. 16 illustrates the use of a finger projection 48 on the cap 22 to facilitate rotation. Again the body is provided with a cap 50 to prevent air access to the flowable material which, in this embodiment, will be glue. A ring 52 is on the exterior of the body 10. That ring 52 may be magnetic and a magnet 54 may be attached to the coil 22 whereby rotation of the ring 52 rotates the spiral 20 through magnetic influence.

Figure 17:
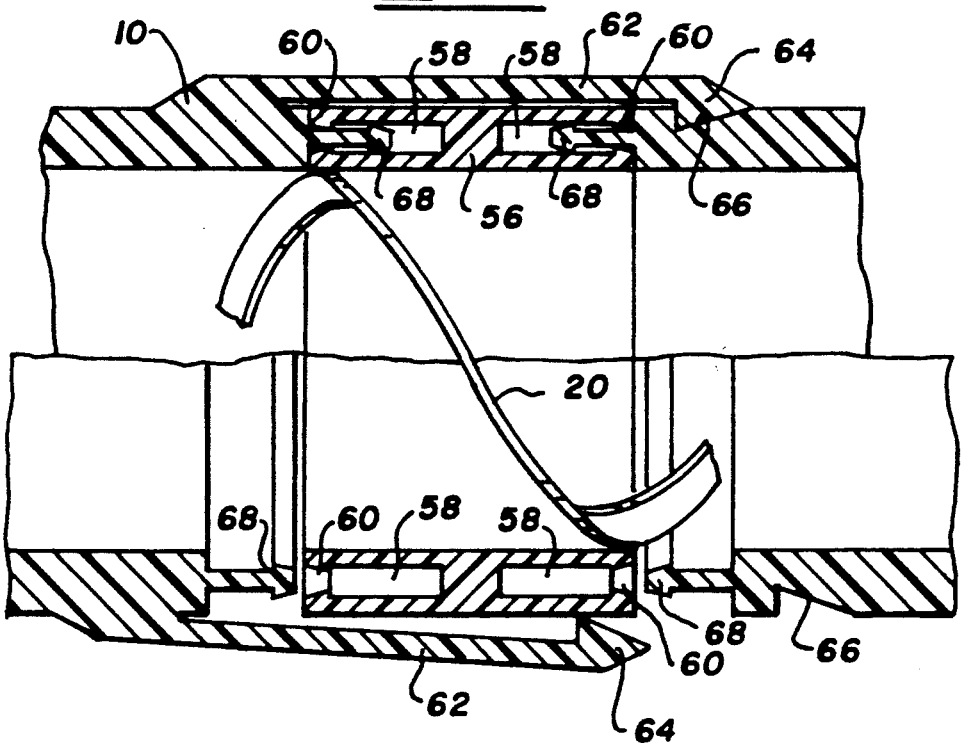
FIG. 17 illustrates as aspect of one-handed operation of the invention.

FIG. 17 shows a body 10 formed in two parts. The coil 20 is attached to a sleeve 56 formed at each end with recesses 58 formed with steps 60 at their outer surfaces. The front of the body is formed with extensions 62 having sloped catch members 64. Two are shown, but more can be located around the periphery of the body member. A rear body portion is formed with recesses 66 to engage the members 62. The front and the rear body portions are formed with prongs 68 to engage in recesses 58 in the collar 56. The prongs 68 have enlarged ends to engage behind the shoulders 60.

This arrangement permits rotation of the collar 56 to which the coil 20 is attached and thus one-handed operation of the device as in the embodiment of FIG. 16.

FIG. 18 shows a pen containing a fluid and formed with a sponge member 70 that engages the coil 20. The sponge member 70 acts to move along with the coil 20, as fluid is expelled from the body. In this way air access to the ink is prevented. The coil extends into the outlet for ink to clear blockages.

FIGS. 18*a* and 19 show glue dispenser where, again rotation of the coil is external by serrated members 72.

FIGS. 20 and 21 illustrate variations in the shape of the body. Again, as in FIG. 5, they show a relatively rapid change in body diameter. They also show, as in FIG. 4, differing elongation of nozzles and variation in coil shape with elongation.

FIGS. 22 and 22*c* merely illustrate the wide variations of external cross-sectional shapes that may be possible. It should be noted that the internal cross-sectional shape is circular or close to it.

FIGS. 23 and 23*a* show the use of a gear driven system. The cap 22 is attached to the spiral 20 and is formed with teeth 74 which engage a planet wheel 76. The planet wheel 76 in turn drives a gear member 78 that is attached to the spiral conveyor 20 at 80 as shown in FIG. 23*a*.

Thus rotation of the cap 22 is conveyed to the coil conveyor 20. Of course, in this way, gearing can be obtained whereby rotation of the cap is not a one to one relationship to rotation of the conveyor. This controls delivery of the flowable material and may be used to speed flow.

FIG. 24 shows the use of a piston 82 mounted on a elongated threaded member 84 passing through the wider section of the body 10. The threaded member is attached to a conveyor 22 within the narrowed portion of the body. The dispenser with a piston does not need additional driving force, but the conveyor in the elongation prevents compression of the material in the elongation.

FIG. 24*a* illustrates the same piston arrangement with an arm 86 at the distal end extending to contact the conveyor 22.

Figure 25:
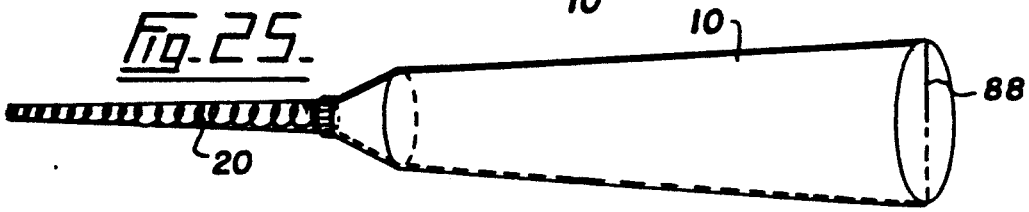
Figure 26:
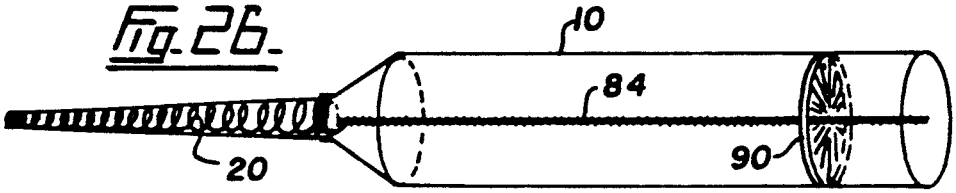

FIG. 25 shows the use of a scraper 88 within the body 10 to remove flowable substance from the wider portion of the body and is generally used when inclined or vertical, when gravity feeds the nozzle. FIG. 26 shows the conveyor 22 of FIG. 24 in position in a body. Rotation is by serrated ring 90.

Figure 27:
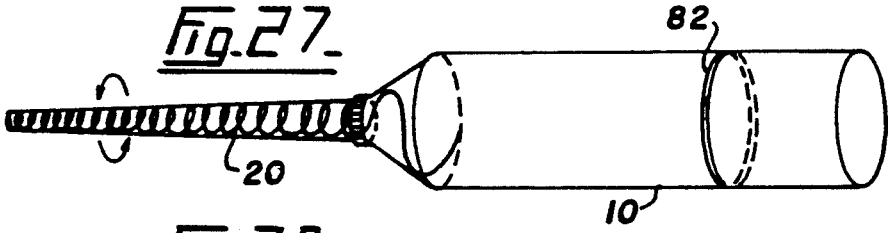

Similarly, FIG. 27 shows a further dispenser including a piston pump.

Figure 28:
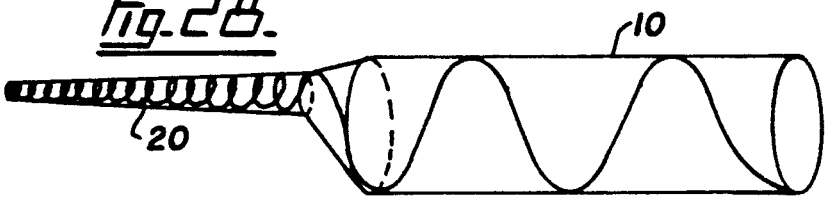
Figure 29:
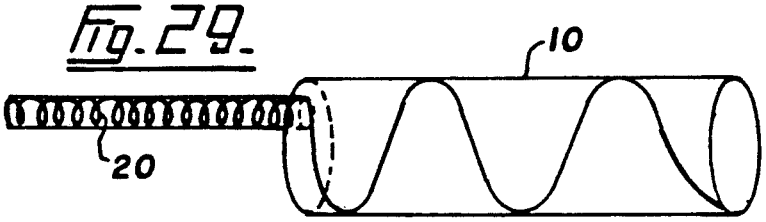

FIGS. 28 and 29 simply show the off-center arrangement of the narrowed portion of the body and again, illustrate the different pitches of the coil 20 depending on whether it is in the narrow or wider portion of the body.

FIG. 30 shows the use of a plant wheel 92 between an outer toothed periphery 94 and a central gear 96 attached to the spiral conveyor 20. FIG. 30 also shows an opening 98 having a closure 100 through which paste may be fed. Rotation of the cap 22 rotates the periphery 94 which then drives through the planet gear 92 to ensure that the smaller diameter conveyor in the narrower portion of the body is driven.

FIGS. 31 and 31*a* show the use of a spring-loaded rack 102 that can engage a small gear wheel 104 attached to the spiral conveyor 20. The rack 102 extends through an opening 106 in the body 10 and is spring-loaded by spring 108 to be urged outwardly of the body. Thus, pressing down of the rack 102 drives the central pin 104 to rotate a screw conveyor. The teeth on the rack and on the center pin can engage in a ratchet and pawl manner whereby the spring, in forcing the rack backwards to the position shown in FIG. 31*a*, does not counterrotate the central gear 104.

FIGS. 32 to 34 illustrate variations in the shape of the body 110 of the dispenser and FIG. 35 illustrates a conveyor 20 that is useful in these body shapes.

FIG. 36, again, illustrates the use of a sponge, precisely analogous to the pen illustrated in FIG. 18 and acting to exclude air from the material in the body.

All of the devices illustrated are operated by simple rotation of the spiral conveyor whether it be by rotation of the cap or by operation of a central ring in contact with the conveyor. All provide extremely fine control of feeding of the flowable material to the outlet and then to a nib, as in FIG. 18, or to bristles as in the toothbrush embodiments.

The present invention has a number of virtues over the prior art. The narrowed portion of the body and the correspondingly shaped portion of the coil are the essence of the invention. Any paste can be difficult to feed in a narrow cross-section and the present invention particularly solves the problem of feeding paste in a narrow cross-section body. By having the coil in contact with at least the walls of the narrower portion of the body, and preferably in contact with the interior of the walls of the whole body, it has been found to provide excellent feeding of the flowable paste. The tendency of the paste to adhere to the walls and then become more dense with each operation as pressure forms layers within the body, is prevented by the conveyor constantly clearing the walls. It has been found that a coil 18 of quite small cross-section is adequate. Coils of surprisingly small diameter compared with the cross-sectional diameter of the body are completely effective. Thus has the advantage of permitting large volumes of paste to be contained, that is the spiral conveyor occupies only a slight volume of the interior of the dispenser. It also reduces accumulation of the flowable material on the conveyor.

The spiral conveyor, particularly in the narrower portion of the body, acts to convey material in the bristles in an efficient manner. Because of the narrowing of the body as it approaches the outlet end, there is a bottle-neck effect and thus a build-up of pressure. The conveyor structure operates to avoid problems that can be brought about by compression of the material.

In effect, the conveyor in the wider portion of the body, which is typically looser, that is contains fewer coils per unit of length and plays a subordinate role, to feed the conveyor in the nozzle. It is the conveyor in the elongated portion of the body that is essential to the present invention. This conveyor preserves and secures the narrow passage from accumulation of material on the inner walls, the build up of which will block the narrow passageway when that passageway is not equipped with a spiral conveyor and in contact with the walls. The provision of the conveyor right to the outlet means that the device can be left for substantial periods and yet still not block. The feeding action is still completely effective despite only intermittent use.

Furthermore, the conveyor provides efficient control. Just the right amount of paste can be fed by gentle rotation of the cap and thus of the conveyor. There is negligible pressure build-up within the container, as might be the case with a piston system of the prior art. The conveyor overcomes the bottle neck effect produced by the meeting of the large and small diameters of the body.

The coil can be resilient. This permits the use of a resilient body which is important for toothbrushes. Therefore, a body can be shaped by the user depending on the use. Furthermore, because the coil is flexible one coil can be used in a variety of bodies.

I claim:

1. A toothbrush having a hollow body to receive toothpaste, the body being generally conical and having a wider and a narrower end;

an end member received on the narrow end of the body;

bristles at the narrower end, mounted on the end member;

an outlet for toothpaste at the narrower end of the body, communicating the interior of the body with the bristles;

a spiral conveyor within the hollow body able to rotate relative to the body to convey toothpaste through the outlet to the bristles, the conveyor extending from the outlet into the bristles and being a flexible, resilient coil of narrow cross-section and thus of small volume, occupying only a small portion of the volume of the interior of the body and closely adjacent the interior of the hollow body throughout the body;

the spiral conveyor being anchored to the bristles whereby rotation of the body relative to the spiral conveyor conveys toothpaste from the body to the bristles.

* * * * *